United States Patent [19]

Draxler et al.

[11] Patent Number: 4,768,471

[45] Date of Patent: Sep. 6, 1988

[54] ALARM SYSTEM FOR MARINE DRIVE

[75] Inventors: James R. Draxler; Steven K. Hansen, both of Fond du Lac, Wis.

[73] Assignee: Brunswick Corporation, Skokie, Ill.

[21] Appl. No.: 109,156

[22] Filed: Oct. 15, 1987

[51] Int. Cl.[4] ..... F01P 11/16; F01M 1/20; F02B 77/08

[52] U.S. Cl. ..... 123/41.15; 123/198 D; 123/196 S

[58] Field of Search ..... 123/41.15, 196.5, 198 D

[56] References Cited

U.S. PATENT DOCUMENTS

| | | | |
|---|---|---|---|
| 4,019,489 | 4/1977 | Cartmill | 123/41.15 X |
| 4,147,151 | 4/1979 | Wright | 123/196.5 X |
| 4,648,364 | 3/1987 | Wills | 123/198 D |
| 4,704,598 | 11/1987 | McLeod | 123/196.5 X |

*Primary Examiner*—Willis R. Wolfe

*Attorney, Agent, or Firm*—Andrus, Sceales, Starke & Sawall

[57] ABSTRACT

In a marine drive having a wiring harness (14) connected between the engine (2) and the helm (8), an alarm sensing module (26) is connected to the harness (14) and provides a warning of one or more abnormal engine conditions, without altering the existing wiring harness or adding wires thereto. A temperature switch (30) and an oil pressure switch (32) are provided at the engine, and the sensing module (26) is connected to the engine temperature gauge (10) and engine oil pressure gauge (12) at the helm. The module activates an alarm (28) in response to high engine temperature or low engine oil pressure.

14 Claims, 2 Drawing Sheets

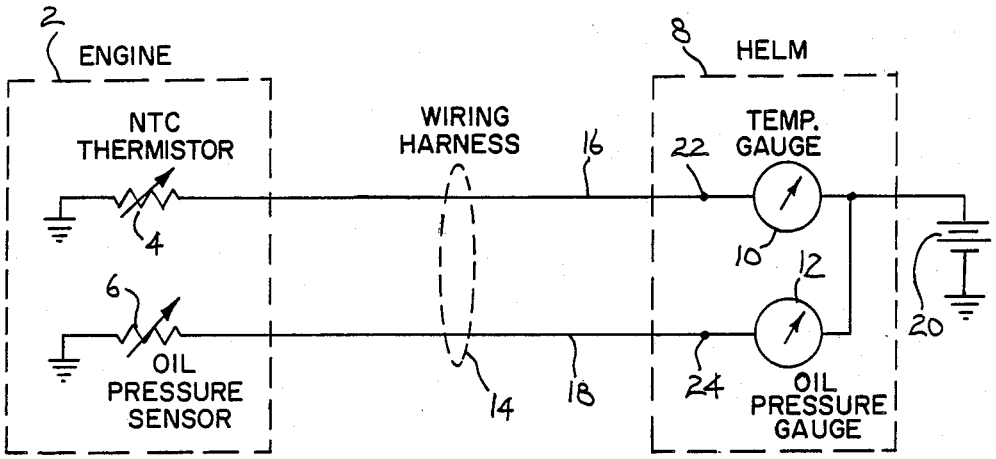
FIG. 1
PRIOR ART
FIG. 2
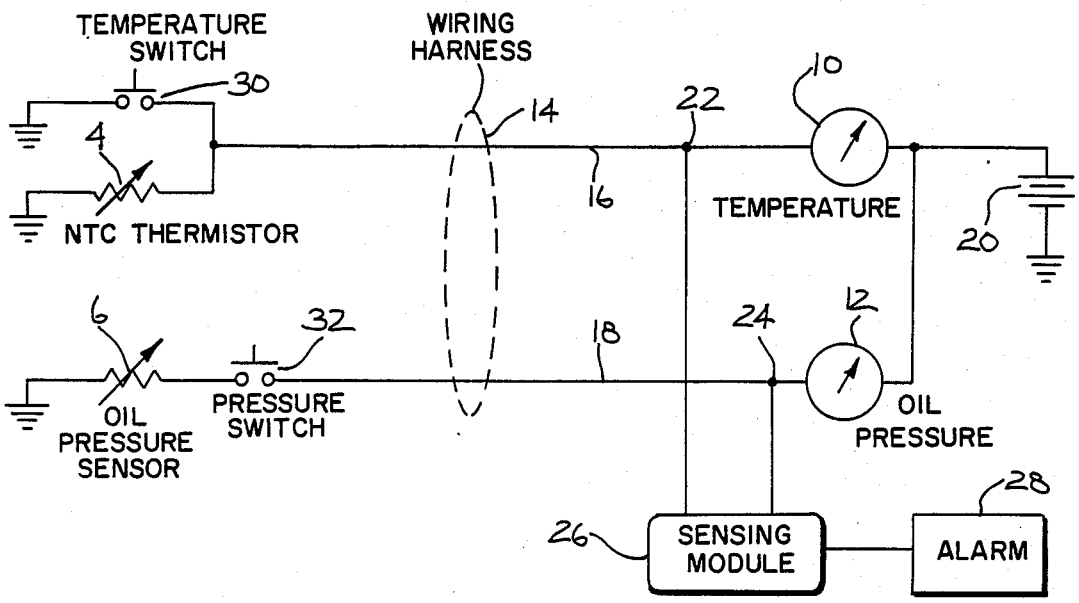

ALARM SYSTEM FOR MARINE DRIVE

BACKGROUND AND SUMMARY

The invention relates to an alarm system for a marine drive for providing a warning of abnormal engine conditions such as high temperature or low oil pressure. The invention arose from efforts to provide an additional warning system, beyond the normal gauges already present, without altering or adding wires to the wire harness between the engine and the helm.

In a marine drive, a wiring harness is connected between the engine and the boat helm for completing various circuits therebetween. The engine typically includes various sensors for sensing given conditions of the engine, such as temperature and oil pressure. The helm typically includes various gauges for indicating sensed the engine conditions. The wiring harness includes a wire dedicated to the temperature sensing function and connected between the engine temperature sensor and the temperature gauge at the helm, and another wire dedicated to the oil pressure sensing function and connected between the engine oil pressure sensor and the oil pressure gauge at the helm.

It is cost-objectionable to alter or add to the existing wiring harness. The present invention enables the addition of an engine condition warning system without requiring changes to the existing controls or wiring harness. In the present invention, a single wire in the harness services both the gauge function and the alarm function, and allows the addition of the alarm without requiring an additional wire. This is desirable because it leaves intact the existing wiring harness between the engine and the helm.

BRIEF DESCRIPTION OF THE DRAWINGS

FIG. 1 shows engine condition gauge circuitry known in the prior art.

FIG. 2 shows engine condition gauge and alarm circuitry in accordance with the invention.

DETAILED DESCRIPTION

Prior Art

Figure 3:
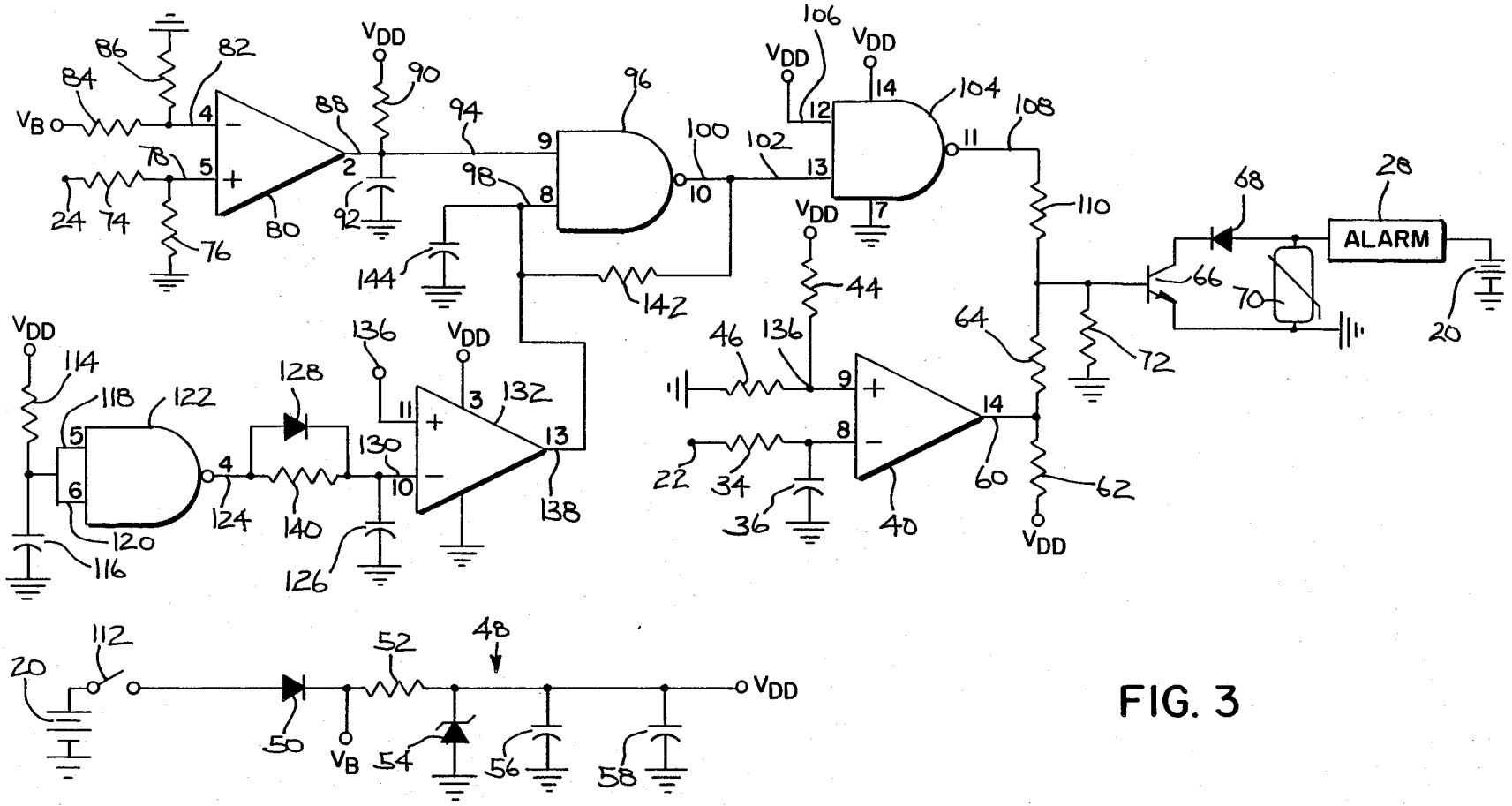
FIG. 3 is a further detailed circuit diagram of the circuitry of FIG. 2.

FIG. 1 shows circuitry known in the prior art. A marine engine 2 has engine condition sensors sensing given conditions of the engine. Negative temperture coefficient, NTC, thermistor 4 senses engine temperature, and is provided by a Mercury Marine Part No. 36525. Oil pressure sensor 6 is provided by a Mercury Marine Part No. 90806 and senses engine oil pressure. The boat helm 8 has engine condition gauges indicating the noted engine conditions. Temperature gauge 10 is provided by a Mercury Marine Part No. 79-07179 and indicates engine temperature. Oil pressure gauge 12 is provided by a Mercury Marine Part No. 79-15114 and indicates engine oil pressure. A wiring harness 14 is connected between engine 2 and helm 8 to provide a circuit connection from thermistor 4 to temperature gauge 10 via wire 16, and to provide a circuit connection from oil pressure sensor 6 to oil pressure guage 12 via wire 18. The boat battery 20 is connected to each of gauges 10 and 12 to supply voltage to such gauges and to thermistor 4 and pressure sensor 6 in series with respective gauges 10 and 12.

In operation, as engine temperature rises, the resistance of thermistor 4 decreases, and the voltage at gauge terminal 22 decreases, which in turn provides an increasing temperature indication on gauge 10. As engine oil pressure decreases, the resistance of oil pressure sensor 6 increases, which provides increasing voltage at gauge terminal 24, which in turn provides decreasing oil pressure indication on gauge 12.

Present Invention

FIG. 2 shows the circuitry of FIG. 1 plus the additional warning system in accordance with the invention, and uses like reference numerals from FIG. 1 where appropriate to facilitate clarity. Alarm sensing module 26 is connected to wiring harness 14 and wires 16 and 18 at respective gauge terminals 22 and 24. Module 26 senses a given state of engine temperature or engine oil pressure without additional wires in the wiring harness. Module 26 actuates an audio and/or visual alarm 28 in response to the given engine condition state. In the disclosed embodiment, alarm 28 is a horn, Mercury Marine Part No. 68878. The alarm function is provided without changing the existing wiring harness 14 between the engine and the helm.

Thermistor 4 varies the voltage on wire 16 in an analog manner in response to changes in engine temperature, to provide an analog voltage signal for temperature gauge 10. A temperature sensitive switch 30, provided by a Mercury Marine Part No. 48952, is connected to wire 16 in parallel with thermistor 4 and also senses engine temperature. At low engine temperatures, switch 30 is open. When engine temperature rises above a given value, switch 30 closes, which in turn substantially reduces the voltage on wire 16 at gauge terminal 22, which reduction of voltage is sensed by module 26 to actuate alarm 28. Temperature switch 30 abruptly changes the voltage on wire 16 to a reduced level to provide a triggering signal for sensing module 26. Wire 16 thus carries two information signals, the gauge indication signal for gauge 10 and the alarm indication signal for module 26.

An oil pressure responsive switch 32, provided by a Stewart Warner Part No. 364AF, is connected in series with oil pressure sensor 6 and also senses engine oil pressure. At high oil pressure, which is the normal condition, switch 32 is closed. When oil pressure switch 32 is closed, pressure sensor 6 varies the voltage on wire 18 in an analog manner in response to changes in engine oil pressure, to provide an analog voltage signal for oil pressure gauge 12 to indicate engine oil pressure. When oil pressure drops below a given value, switch 32 opens, which substantially increases the voltage on wire 18 at gauge terminal 24, which increased voltage is sensed by module 26 to actuate alarm 28. Oil pressure switch 32 responds to engine oil pressure below the given value to switch states and abruptly change the voltage on wire 18 to provide the trigger signal for alarm sensing module 26. The engine oil pressure gauge indication signal for gauge 12 and the engine oil pressure alarm indication signal for sensing module 26 are both carried on the same wire 18.

FIG. 3 shows the circuitry of sensing module 26. The voltage at temperature gauge terminal 22 is supplied through an RC filter provided by resistor 34 and capacitor 36 to the inverting input 38 of comparator 40. Comparators 40, 80 and 132 are provided by a 2901 integrated circuit chip, and manufacturer assigned pin number designations are shown for clarity. The noninverting input 42 of comparator 40 is supplied with a reference voltage $V_{DD}$ through the voltage divider network provided by resistor 44 and 46.

$V_{DD}$ is provided by power supply 48 connected to boat battery 20. Power supply 48 is standard in the art. Diode 50 provides polarity protection. Resistor 52 provides current limiting. Zener diode 54 limits and regulates the voltage. Capacitors 56 and 58 provide filtering.

At low engine temperature, switch 30, FIG. 2, is open, and the resistance of thermistor 4 is high, such that the voltage on wire 16 at terminal 22 is high, and the voltage at comparator input 38 is higher than that at comparator input 42, such that comparator output 60 is low. When engine temperature rises above a given value, switch 30 closes, and the voltage on wire 16 at terminal 22 drops, which in turn drops the voltage at comparator input 38 below that at reference input 42, such that comparator output 60 goes high, as pulled up by pull-up resistor 62. This high signal is applied through current limiting resistor 64 to the base of NPN bipolar transistor 66 to bias the latter into conduction. Conduction of transistor 66 completes a circuit from boat battery 20 through alarm 28 through polarity protective diode 68 through transistor 66 to ground. Varistor 70 provides dv/dt protection. Resistor 72 reduces base drive sensitivity of transistor 66 to prevent nuisance or noise actuation of the alarm.

The voltage on wire 18 at oil pressure gauge terminal 24 is supplied through the voltage divider network provided by resistors 74 and 76 to the noninverting input 78 of comparator 80. Inverting input 82 is supplied with voltage $V_B$ through the voltage divider network provided by resistors 84 and 86. $V_B$ is the voltage at the cathode of diode 50 in power supply 48. At high engine oil pressure, oil pressure switch 32 is closed and the resistance of oil pressure sensor 6 is low, such that the voltage on wire 18 and terminal 24 is low, such that the voltage at comparator input 78 is below that at comparator input 82, and comparator output 88 is low. When engine oil pressure drops below a given value, switch 32 opens, which substantially increases the voltage on wire 18 and terminal 24, such that the voltage at comparator input 78 increases above that at reference input 82, and comparator output 88 goes high, as pulled up through pull-up resistor 90. Capacitor 92 holds a steady voltage level at input 94 to NAND gate 96.

NAND gates 96, 104 and 122 are provided by a 4093 integrated circuit chip, and manufacturer assigned pin number designations are shown for clarity. When comparator output 88 goes high, NAND gate input 94 goes high, and assuming input 98 of the NAND gate is also high, the NAND gate output 100 will be low. This low state is supplied to one input 102 of NAND gate 104, whose other input 106 is tied high to $V_{DD}$, and hence the output 108 of NAND gate 104 goes high. This high state at output 108 is applied through current limiting resistor 110 to the base of transistor 66 to bias the latter into conduction, which in turn completes a circuit through alarm 28 to actuate the latter.

When engine oil pressure is high, the voltage at comparator input 78 is below that at comparator input 82, and comparator output 88 is low, such that NAND gate output 100 is high, such that NAND gate output 108 is low and will not bias transistor 66 into conduction, whereby alarm 28 is off.

At initial turn-on of the engine, switch 112 in power supply 48 is closed, to develop $V_{DD}$. $V_{DD}$ is applied through resistor 114 to charge capacitor 116. Until capacitor 116 is charged to a given level, inputs 118 and 120 of NAND gate 122 are low, whereby the NAND gate output 124 is high. This high signal quickly charges capacitor 126 through diode 128 such that the voltage at inverting input 130 of comparator 132 is above that at input 134. The voltage at input 134 is supplied from node 136 between resistors 44 and 46, which is the divided down voltage from $V_{DD}$. Since the voltage at input 130 is above that at reference input 134, the comparator output 138 is low, which provides a low state at NAND gate input 98, such that NAND gate output 100 is high, and NAND gate output 108 is low, such that transistor 66 and alarm 28 are off. When NAND gate input 98 is low, output 100 is high and alarm 28 is off, regardless of the state of NAND gate input 94. This is desired because at initial start-up of the engine, oil pressure is zero, and hence the voltage on wire 18 and terminal 24 is high, and hence the voltage at comparator input 78 is high, whereby comparator output 88 and NAND gate input 94 are high. Notwithstanding this high state at NAND gate input 94, the low state of NAND gate input 98 keeps alarm 28 off.

After a given delay following start-up of the engine, preferrably about ten seconds, capacitor 116 charges sufficiently that NAND gate inputs 118 and 120 are high, whereby output 124 of NAND gate 122 goes low. The low state of NAND gate output 124 discharges capacitor 126 through resistor 140, driving comparator input 130 low, such that the voltage at input 130 drops below that at reference input 134, and comparator output 138 goes high. The high state of comparator output 138 presents a high state at NAND gate input 98, which in turn enables the state of NAND gate output 100 to be controlled by the state of NAND gate input 94. Thus, at the end of the ten second delay following turn-on of the engine, capacitor 116 charges sufficiently, and comparator output 138 goes high, and if the engine oil pressure is still below the given value, the voltage at comparator input 78 will be high and the voltage at NAND gate input 94 will be high, and NAND gate output 100 will go low, whereby NAND gate output 108 will go high and turn on transistor 66 to actuate alarm 28. The alarm signal on wire 18 at terminal 24 from pressure switch 32 is ignored during the delay interval provided by RC circuit 114, 116, to prevent a false alarm at initial start-up of the engine when engine oil pressure is zero. The alarm is actuated at the end of the delay interval if oil pressure is not up to the given value.

In order to distinguish between a high temperature alarm and a low oil pressure alarm, an oscillator is provided responsive to the alarm signal from either the pressure switch or the temperature switch to provide a pulsating alarm for such respective condition. In FIG. 3, NAND gate output 100 is connected through resistor 142 to NAND gate input 98, which input also has a capacitor 144 connected thereto. When NAND gate output 100 goes high, this high signal is applied through resistor 142 to charge capacitor 144. When capacitor 144 charges sufficiently, NAND gate input 98 goes high, which, if input 94 is high, causes output 100 to go low. This low state of output 100 discharges capacitor 144 through resistor 142. When capacitor 144 discharges sufficiently, input 98 goes low which in turn causes output 100 to go high, thus completing a cycle of oscillation. This oscillation provides a pulsating output at 100 when input 94 is high. The pulsating output 100 provides a pulsating output 108 which in turn pulses transistor 66 on and off, and in turn pulsates alarm 28, indicating a low oil pressure condition of the engine.

NAND gate 104 provides a buffer between the oil pressure sensing portion of the circuitry and the temperature sensing portion of the circuitry. The switching of output 60 of the temperature responsive comparator 40 does not affect the pressure responsive circuitry upstream of NAND gate 104.

It is recognized that various equivalents, alternatives and modifications are possible within the scope of the appended claims.

We claim:

1. In a marine drive having an engine with engine condition sensing means sensing at least one of a plurality given conditions of said engine, a helm with engine condition gauge means indicating said engine conditions, and wiring harness means connected between said engine and said helm to provide a circuit connection from said engine condition sensing means to said engine condition gauge means, said gauge means having a dedicated gauge for each of said sensed engine conditions, said harness means having a dedicated wire for each of said sensed engine conditions and connected to a respective one of said gauges, the improvement comprising alarm sensing module means connected to said wiring harness means and sensing a given state of at least one of said plural engine conditions without additional wires in said wiring harness means, said alarm sensing module means being connected to the respective said wire for the respective said engine condition and providing an alarm in response to said given state, such that said alarm function is provided without changing the existing wiring harness means between said engine and said helm, and comprising engine condition alarm responsive means at said engine responding to said given state of at least one of said engine conditions and changing the voltage on a respective said wire to actuate said alarm sensing module means to provide said alarm, such that said engine condition gauge indication and said engine condition alarm indication are carried on the same single respective said wire.

2. The invention according to claim 1 comprising voltage supply means connected in circuit with said engine condition gauge means, said engine condition sensing means, said alarm sensing module means, and said engine condition alarm responsive means, and wherein:

said engine gauge means comprises:

an engine temperature gauge;

an engine oil pressure gauge;

said engine condition sensing means comprises:

a temperature sensor sensing engine temperature and connected by a respective one of said wires in said harness to said temperature gauge and varying the voltage on said one wire in said harness in an analog manner in response to changes in engine temperature, to provide an analog voltage signal for said temperature gauge to indicate engine temperature;

a pressure sensor sensing engine oil pressure and connected by another respective said wire in said harness to said oil pressure gauge and varying the voltage on said other wire in said harness in an analog manner in response to changes in engine oil pressure, to provide an analog voltage signal for said oil pressure gauge to indicate engine oil pressure;

said engine condition alarm responsive means comprises:

a temperature switch connected to said one wire in said harness and responsive to engine temperature above a given value to switch states and abruptly and substantially change the voltage on said one wire in said harness, to provide an alarm signal for said alarm sensing module means to provide said alarm;

a pressure switch connected to said other wire in said harness and responsive to engine oil pressure below a given value to switch states and abruptly and substantially change the voltage on said other wire in said harness, to provide an alarm signal for said alarm sensing module means, to provide said alarm.

3. The invention according to claim 2 wherein:

said temperature switch is connected in parallel with said temperature sensor and is open at temperatures below said given value, and closed at temperatures above said given value; and said pressure switch is connected in series with said oil pressure sensor and is closed at oil pressures above said given value, and open at oil pressures below said given value.

4. The invention according to claim 2 comprising means ignoring the alarm signal from said pressure switch and preventing said alarm for a delay interval at start-up of said engine, to prevent a false alarm at start-up of the engine when engine oil pressure is zero, said alarm being provided at the end of said interval if oil pressure is not up to said given value.

5. The invention according to claim 4 comprising oscillator means responsive to the alarm signal from one of said pressure switch and said temperature switch to provide a pulsating said alarm, to distinguish a high temperature condition of said engine from a low oil pressure condition of said engine.

6. In a marine drive comprising an engine with an engine temperature sensor and an engine oil pressure sensor, a helm with an engine temperature gauge and an engine oil pressure gauge, and a wiring harness connected between said engine and said helm and having one wire connected between said temperature sensor and said temperature gauge and another wire connected between said oil pressure sensor and said oil pressure gauge, the improvement comprising:

first voltage comparator means comparing the voltage on said one wire against a reference voltage and outputting an alarm signal when said engine temperature rises above a given value;

second voltage comparator means comparing the voltage on said other wire against a reference voltage and outputting an alarm signal when engine oil pressure drops below a given value;

alarm means responsive to said outputs of said first and second comparator means to provide an alarm.

7. The invention according to claim 6 wherein said alarm means comprises a single alarm connected at a common node to each of said first and second comparator means to be actuated by either.

8. The invention according to claim 7 comprising buffer means connected between one of said comparator means and said common node to isolate said one comparator means from switching effects of said other comparator means.

9. The invention according to claim 7 comprising oscillator means in circuit with one of said comparator means to provide a pulsating alarm signal therefrom to pulse said alarm, to distinguish a high temperature condition from a low oil pressure condition.

10. The invention according to claim 6 comprising means ignoring the alarm signal from said second comparator means and preventing said alarm for a delay interval at start-up of said engine, to prevent a false alarm at start-up of said engine when engine oil pressure is zero, said alarm being provided at the end of said interval if oil pressure is not up to said given value.

11. The invention according to claim 10 wherein said last mentioned means comprises third comparator means having an input through an RC charging network compared against a reference input to have a delayed output following start-up of said engine, said delayed output of said third comparator means enabling the output of said second comparator means to provide said alarm signal.

12. The invention according to claim 11 comprising AND gate means having one input from said second comparator means and another input from said third comparator means and having an output to said alarm means.

13. The invention according to claim 12 comprising a feedback network from the output of said AND gate means to the second mentioned input of said AND gate means, said feedback network including oscillator means providing a pulsating output of said AND gate means in response to said alarm signal from said second comparator means when enabled by said third comparator means.

14. The invention according to claim 12 comprising second AND gate means connected between said first mentioned AND gate means and said alarm means and providing a buffer to isolate said first AND gate means from said first comparator means.

* * * * *